United States Patent [19]

Sugiura

[11] 4,408,559

[45] Oct. 11, 1983

[54] IMAGE FIXING DEVICE

[75] Inventor: Yoshinori Sugiura, Kawasaki, Japan

[73] Assignee: Canon Kabushiki Kaisha, Tokyo, Japan

[21] Appl. No.: 311,895

[22] Filed: Oct. 15, 1981

[30] Foreign Application Priority Data

Oct. 27, 1980 [JP] Japan ..... 55/153287[U]

[51] Int. Cl.[3] ..... B05C 11/00

[52] U.S. Cl. ..... 118/60; 118/70; 118/104; 432/60

[58] Field of Search ..... 118/60, 70, 101, 104, 118/116; 432/60; 219/216

[56] References Cited

U.S. PATENT DOCUMENTS

| | | | |
|---|---|---|---|
| 2,950,502 | 8/1960 | Weaver | 264/134 |
| 3,924,564 | 12/1975 | Bar-on | 118/60 |
| 3,941,558 | 3/1976 | Takiguchi | 118/70 |
| 3,996,888 | 12/1976 | Lofdahl et al. | 118/70 |

FOREIGN PATENT DOCUMENTS

| | | | |
|---|---|---|---|
| 52-155537 | 12/1977 | Japan | 118/60 |

*Primary Examiner*—Bernard D. Pianalto

*Attorney, Agent, or Firm*—Fitzpatrick, Cella, Harper & Scinto

[57] ABSTRACT

An image fixing device having a rotatable fixing member to fix a toner image formed on an image holding member by an image forming process such as electrophotographic process, electrostatic recording process, magneto-photographic process, etc. under pressure or heat application to the image holding member; a thin film member holding therein a parting or releasing agent; and a plurality of urging members to be press-contacted to the fixing member through the thin film member. The device has such effects that it exhibits satisfactory cleaning effect of the rotatable fixing member over a long period of time, enables the parting agent to be uniformly and stably applied onto the fixing member, and prevents an offset phenomenon from occurring by synergistic effects of the satisfactory cleaning and the uniform liquid application, thereby improving the life of the fixing roller to a remarkable extent.

20 Claims, 3 Drawing Figures

IMAGE FIXING DEVICE

BACKGROUND OF THE INVENTION

1. Field of the Invention

This invention relates to an image fixing device for fixing a toner image formed on an image holding member such as plain paper, photosensitive paper, etc. by the electrophotographic process, electrostatic recording process, magnetophotographic process, and others.

2. Description of the Prior Art

For the image fixing device to fix a toner image on an image bearing member, there has heretofore been used mostly a device of a type which imparts heat or pressure to the toner image in direct contact with the toner image or the image bearing member to thereby fix the image.

In this type of image fixing device, e.g., a heat-fixing device, the toner image bearing member is caused to pass between a fixing roller (i.e., heating roller) and a press-contacting roller in such a manner that the toner image bearing surface of the member may contact with the heating roller. For the toner image not to offset to the surface of the heating roller, it is coated with an offset preventive material such as silicone rubber, tetrafluoroethylene resin, etc. However, when the surface temperature of the heating roller is increased for improving the image fixing capability, or when the offset preventive material on the roller surface becomes deteriorated, the toner image tends to readily offset to the heating roller, and, at its extremity, the toner image bearing member rolls around the heating roller. In order to avoid such inconveniences, it has so far been a practice to apply offset preventing liquid (liquid parting or releasing agent) onto the surface of the fixing roller by means of a felt roller, etc.

When the offset preventing liquid is coated on the fixing roller surface, it is necessary that the liquid to be applied to the surface of the heating roller or the press-contacting roller be in an appropriate quantity. For the liquid applying member, there may be used generally heat-resistant felt or heat-resistant cloth having the property of absorbing and retaining the offset preventing liquid therein utilizing capillary action. There are two methods of coating the liquid: the one is to urge the abovementioned heat-resistant felt or cloth direct by to the heating roller; and the other is to transfer the parting agent (offset preventing liquid) by urging the felt or cloth having the property of absorbing and retaining the liquid parting agent to the liquid applying roller, by which roller the parting agent is applied onto the heating roller or the press-contacting roller. However, even when the offset preventing liquid is applied to the fixing roller by the abovementioned methods, there still occurs slight offset phenomenon. For removing this offset phenomenon, it has been the general practice to provide a separate cleaning device. This cleaning device is made of heat-resistant felt, heat-resistant cloth, or the like. Even with such cleaning device, however, the cleaning effect does not reach its perfection (100%) while the heating roller is in rotation, and there remains a very small quantity of the offset toner on the fixing roller surface. The toner which stays on the heating roller by such insufficient cleaning gradually accumulates on the roller or the felt as the offset preventing liquid applying member to make it unable to uniformly coat the offset preventing liquid.

SUMMARY OF THE INVENTION

It is therefore an object of the present invention to provide an image fixing device which is free from the above-mentioned various defects inherent in the conventional fixing device, and capable of producing excellent cleaning effect with the fixing roller and other image fixing members, and of effecting stable application of the parting agent onto the fixing roller.

According to the present invention, in general aspect thereof, there is provided an image fixing device comprising: fixing means having a rotatable fixing member for fixing a toner image to an image bearing member, on which the toner image is held; a thin film member containing therein a parting agent; and a plurality of urging members which press-contact to the fixing member through the thin film member.

By the image fixing device of the present invention, satisfactory cleaning of the rotatable fixing member and more stable application of the parting agent becomes possible over a longer period than ever. In addition, by the synergistic effect of the satisfactory cleaning and stable liquid application, the undesirable offset phenomenon can be prevented effectively.

DETAILED DESCRIPTION OF PREFERRED EMBODIMENT

Figure 1:
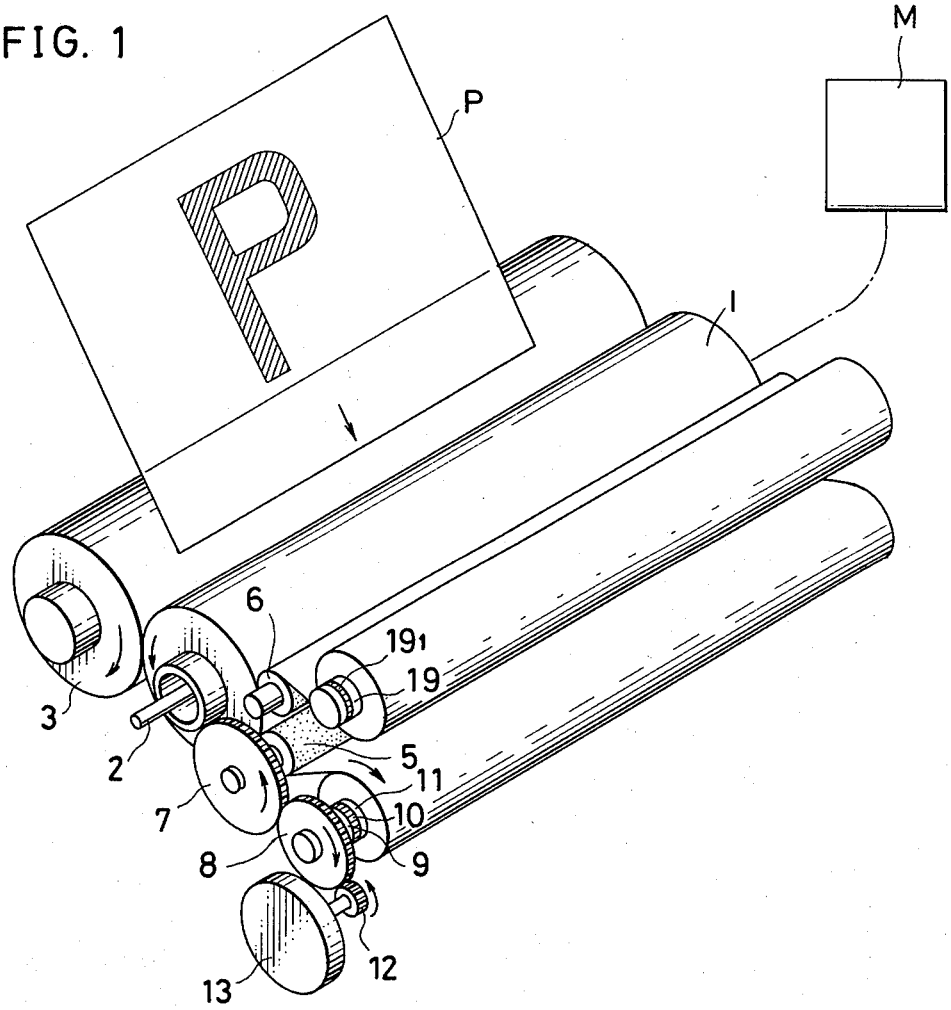
FIG. 1 is a schematic perspective view of one embodiment of the image fixing device according to the present invention.

Referring to FIG. 1, a heater 2 is provided within the heat-fixing roller 1, onto which the toner image bearing surface of a toner image bearing member P such as plain paper, etc. is press-contacted. The heater 2 supplies heat energy required for melting toner powder and fixing the same onto the toner image bearing member. The heating roller 1 is made of a metal roller, on which surface chromium plating or a thin film of tetrafluoroethylene resin are provided, and is rotatably supported by a well known supporting means. A press-contacting roller 3 is constructed with a metal core, the outer periphery of which is covered with a relatively thick layer of resilient material such as silicone rubber, etc., and moves relatively between a position for its press-contact to the heating roller 1 (fixing process) and a position for its non-contact thereto (non-fixing process) by a well known pressure applying mechanism (not shown) and a well-known supporting means (also not shown, but it designates a well-known pressure applying and releasing means). The heating roller 1 is driven in an arrow direction by a drive motor M. The press-contacting roller 3 frictionally rotates in accordance with rotation of the heating roller 1, whereby the toner image is fixed, while the toner image bearing member P inserted between the rollers 1 and 3 are being conveyed. The web 4 is made of a sheet member having heat-resistant property such as non-woven cloth, etc., is impregnated with an appropriate quantity of the parting agent, and wound in a roll form. In the course of its being taken up on a take-up shaft 11, the web 4 is forwarded in contact with the peripheral surfaces of the urging rollers 5, 6, while it is being pressed toward the heat-fixing roller 1 by these rollers. The urging rollers 5, 6 are made of spongy material or those heat-resistant members capable of absorbing the parting agent. The rollers have the function of absorbing a part of the releasing (or parting) agent impregnated in the web 4 and discharging the same at the pressure applying portion so as to regulate a quantity of the releasing agent to be applied to the heat-fixing roller 1. A large gear 7 is mounted at one end of the urging roller 5. Also, a small gear 8 to be meshed with the large gear 7 is mounted on the same end side of a web take-up drive shaft 9. The urging roller 6 is rotated in accordance with the drive shaft 9. The web take-up drive shaft 9 causes the web take-up shaft 11 to rotate through a slip clutch 10. The small gear 8 is further meshed with another gear 12 mounted on a shaft of a web driving motor 13. The positional relationship between the urging rollers 5 and 6 is such that the roller 6 is disposed at the upstream position and the roller 5 is provided at the downstream position with respect to the rotational direction of the fixing roller 1.

The web driving motor 13 rotates at a very slow speed either continuously or intermittently. A gear ratio between the large gear 7 and the small gear 8 is so set that the peripheral speed of the outer periphery of the web take-up shaft 11 may be faster than the peripheral speed of the outer periphery of the urging rollers 5, 6. A core material 19 for the web 4 (in roll) is applied with an appropriate brake $19_1$ (as known brake device being used) which causes a suitable tension to generate in the web when it is let out by frictional force between the web urging roller 5 and the web 4 due to rotation of the urging roller 5. Further, since the peripheral speed of the web take-up drive shaft 9 is faster than the web forwarding speed from the abovementioned gear ratio, there takes place slippage between the drive shaft 9 and the clutch 10 provided around the web take-up shaft 11. At this instant, a tension is generated in the web at a position between the web urging roller 5 and the web take-up shaft 11, whereby the web 4 is wound around the web take-up shaft 11 with appropriate tightness.

Figure 2:
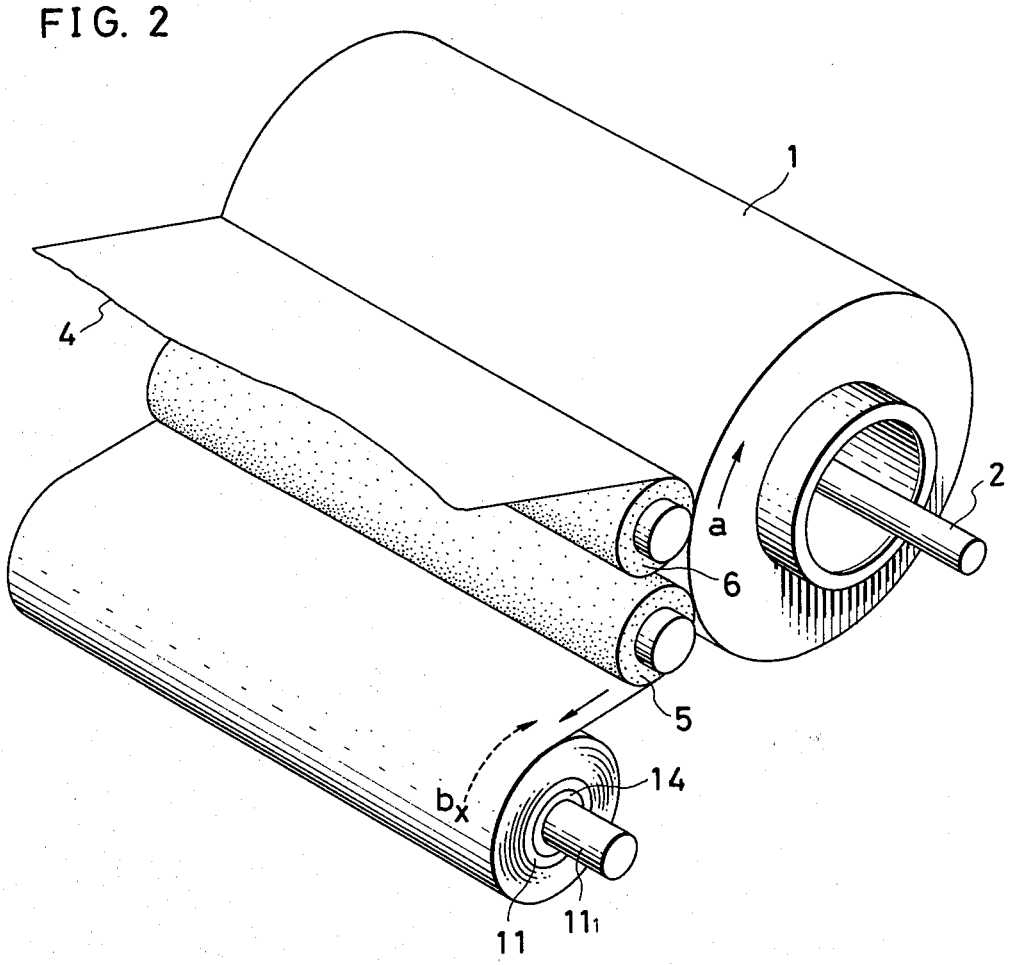
FIG. 2 is a perspective view showing a state, wherein a web of thin film member is press-contacted to the heating roller by means of urging rollers.

The web take-up shaft 11 is equipped with a one-way clutch 14 between a shaft $11_1$ supported on a fixed plate within the device and the web take-up shaft 11, as shown in FIG. 2. When the heating roller 1 rotates in an arrow direction a, the web take-up shaft 11 does not rotate in the direction of a dash-lined arrow b, but in its take-up direction so that the web 4 may not be drawn out in the arrow direction b by frictional force between the web 4 and the heating roller 1.

Figure 3:
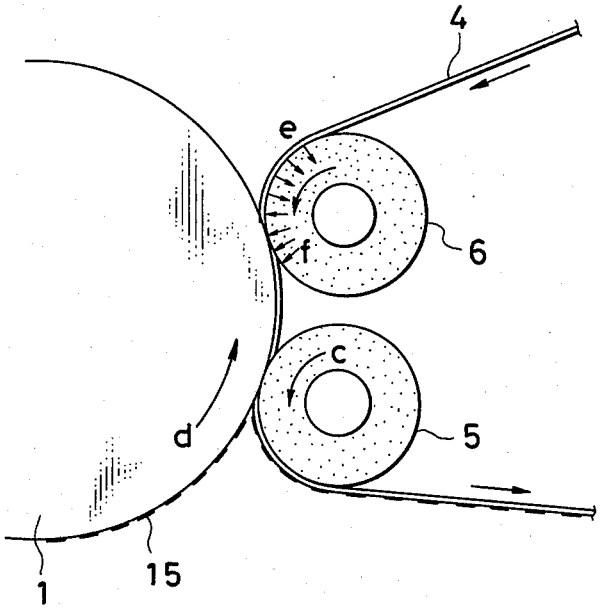
FIG. 3 is an enlarged, fragmentary side view of the press-contacting section in FIG. 2.

FIG. 3 is a schematic diagram for explaining the functions of cleaning the heating roller 1 by the web 4 and the web urging roller 5, and of applying the offset preventing liquid onto the heating roller 1 by the web urging roller 6.

The web 4 is conveyed in the direction opposite to the rotational direction d of the heating roller 1, i.e., in the same direction as the rotational direction of the web urging roller 5, in accordance with rotation in the arrow direction c of the web urging roller 5, thereby wiping off the toner 15 remaining on the heating roller 1 after the image fixing. On the other hand, the web urging roller 6 is rotated by the movement of the web 4. At this instant, since the web 4 is impregnated with an appropriate quantity of the releasing (or parting) agent, a part of it is absorbed into the web urging roller 6 as shown by arrows e while the web 4 is in contact with the web urging roller 6. Subsequently, the web 4 is pressed to the heating roller 1 by the web urging roller 6, and a part of the releasing agent impregnated in the web and that absorbed in the web urging roller 6 are squeezed out as shown by arrows f to be applied onto the heating roller 1.

As mentioned above, since the web 4 is press-contacted to the heating roller 1 by the urging roller 5 and 6, a contact area between the web 4 and the heating roller 1 can be freely taken, and the effects of roller cleaning and liquid application can be exhibited satisfactorily, which enables the surface of the heating roller 1 to be maintained in a uniform state over a long period of time. Further, at the web urging section where the web 4 is press-contacted to the heating roller 1 by the web urging rollers 5 and 6, the web 4 functions in such a manner that it works to clean the surface of the heating roller mainly at the roller 5, while it works to apply the releasing agent uniformly on the cleaned surface of the heating roller 1 mainly at the roller 6. Since unused portion of the web 4 is constantly and sequentially forwarded to the roller contacting section, the roller cleaning and the releasing agent application can be done with good effect, which contributes to a remarkable improvement in the service life of the heat-fixing roller. Furthermore, since the application of the offset preventing liquid to the heat-fixing roller and the cleaning thereof, which have so far been done separately, can be effected by one and the same web, the entire mechanism of the image fixing device becomes simple, and the stable application of the releasing agent and cleaning of the heat-fixing roller can be realized.

It should be understood that either one or both of the web urging rollers 5 and 6 may be made of materials that do not absorb the releasing agent. Moreover, not only a pair of web urging rollers are provided as in the afore-described embodiment, but a third or further web urging rollers may be provided between the web urging rollers 5 and 6 to increase the press-contacting area between the web and the heating roller, thereby making it possible to exhibit auxiliary cleaning effect when the cleaning effect of the roller 5 decreases.

Use of a plurality of web urging rollers as in the above-described embodiment is based on consideration of the following problem to occur when a single urging roller is used. That is to say, in case of using a single urging roller, the web urging section formed by the web 4, the heating roller 1, and the web urging roller is small, and, further, the cleaning and the releasing liquid application are simultaneously done at this small section, so that, when the image fixing device is continuously used over a long period of time, or when the moving speed of the web 4 is extremely slow or its non-moving time is long, when toner is absorbed in large quantity in the web urging roller by any accident, or others, there tend to occur such situations that the toner, which remains to be cleaned or which is absorbed in the web urging rollers, gradually accumulates on the web urging section and finally passes through the web urging section without being cleaned, whereby the toner remains on the surface of the heating roller. As the consequence of this, the cleaning effect lowers to accompany a portion on the heating roller where no offset preventing liquid is applied, and, in addition, by the synergistic effect of the insufficient cleaning effect and non-application of the releasing liquid, the effect of liquid application also lowers, whereby the image as reproduced is disturbed to bring about the worst situation where the offset phenomenon and winding of paper around the heating roller take place.

In consideration of such situation, the present invention contemplates to provide a plurality of web urging rollers with a view to securing long-standing and satisfactory effects of toner cleaning and liquid application. In other words, the functions of the toner cleaning and the liquid application are respectively shared by the first web urging roller and the second web urging roller so as to secure a state, wherein the respective functions and resulting effects may be exhibited to a satisfactory extent. For instance, even if the cleaning effect of the first roller reduces for the above-mentioned reason, the residual toner is removed from the surface of the fixing roller by the web situated between the first and second urging rollers, or the second urging roller, whereby the toner cleaning effect becomes stabilized over a long period. Meanwhile, since the liquid application is being conducted stably by the second urging roller, the offset preventing effect is secured. Further, prevention of the cleaning effect from becoming worst is done by the second urging roller which shares the offset preventing liquid application in the main, so that no synergistic effect as mentioned in the foregoing produces, hence no offset phenomenon over a long period of time.

The image fixing device according to the present invention is capable of conducting satisfactory cleaning of the fixing roller surface at every image fixing operation over a long period of time, realizing stable application of the parting agent, and thereby remarkably improving the life of the image fixing roller.

Although the foregoing explanations of the present invention have been made with reference to the heat-fixing, it should also be noted that the invention is applicable to a press-fixing device, wherein the toner image is fixed under pressure.

What I claim is:

1. An image fixing device comprising:

a rotatable fixing member for fixing a toner image onto an image bearing member;

a web member retaining therein a parting agent for coating the parting agent on said fixing member and for cleaning the surface of said fixing member;

a first urging member for sandwiching said web member between it and said fixing member at a first region on the surface of said fixing member and urging said web member against the surface of said fixing member;

a second urging member for sandwiching said web member between it and said fixing member at a second region on the surface of said fixing member downstream of said first region with respect to the direction of rotation of said fixing member, said second urging member urging said web member against the surface of said fixing member; and means for moving said web member in such a manner that said web member is moved at said first and second regions, in a direction opposite to the direction of rotation of said fixing member, whereby said web member mainly cleans said first region of said fixing member and mainly coats the parting agent at said second region of said fixing member.

2. An image fixing device according to claim 1, wherein said second urging member is a porous member capable of absorbing parting agent from and discharging parting agent to said web member to control the amount of parting agent to be retained in said web member.

3. An image fixing device according to claim 2, wherein said first urging member is a porous member capable of absorbing parting agent from and discharging parting agent to said web member to control the amount of parting agent to be retained in said web member.

4. An image fixing device according to claim 2 or 3, wherein said second urging member mainly absorbs parting agent from said web member at an area at which said second urging member is brought into contact with said web member, and said second urging member mainly discharges parting agent to said web member at said second region.

5. An image fixing device according to claim 4, further comprising means for imparting a predetermined tension to a part of said web member which extends from said second urging member in the direction away from said first urging member.

6. An image fixing device according to claim 1, wherein said second urging member comprises a resilient body for urging said web member against said fixing member.

7. An image fixing device according to claim 1, wherein each of said first and second urging members comprises a resilient roller.

8. An image fixing device according to any one of claims 2 to 7, wherein said first region adjoins with said second region on the surface of said fixing member.

9. An image fixing device according to any one of claims 2 to 7, wherein said fixing device includes a heating roller as said fixing member and said fixing device further comprises a pressure roller which is in pressure-contact with said heating roller, whereby the toner image, when it is between said heating roller and said pressure roller, is heated and fixed onto the image bearing member.

10. An image fixing device according to claim 9, wherein said heating roller has an offset preventing layer, and said pressure roller has a resilient layer.

11. An image fixing device according to any one of claims 1 to 7, wherein said first urging member comprises a body of revolution and said moving means includes means for rotationally driving said first urging member to move said web member.

12. An image fixing device according to claim 11, wherein said second urging member comprises a body of revolution driven by said moving web member.

13. An image fixing device according to claim 12, wherein said second urging member comprises a porous resilient roller.

14. An image fixing device according to claim 13, wherein said second urging member comprises a sponge roller.

15. An image fixing device according to claim 11, wherein said first urging member comprises a porous resilient roller.

16. An image fixing device according to claim 15, wherein said first urging member comprises a sponge roller.

17. An image fixing device according to claim 11, wherein said moving means includes a take-up member for taking up said web member away from said first urging member and means for imparting a predetermined tension between said first urging member and said take-up member.

18. An image fixing device according to claim 17, wherein said tension imparting means includes means for driving said take-up member at a peripheral speed higher than the rotational peripheral speed of said first urging member, a transmitting member disposed between said take-up member and said driving means to transmit the drive from said driving means to said take-up member with relative slippage maintained therebetween, and a member for restricting the rotation of said take-up member in one direction.

19. An image fixing device according to claim 18, wherein said moving means includes a member for feeding said web member toward said second urging member and means for imparting a predetermined tension between said second urging member and said feeding member.

20. An image fixing device according to claim 19, wherein said tension imparting means includes a member for braking the rotation of said feeding member.

* * * * *